US011460241B1

(12) United States Patent
Chauhan et al.

(10) Patent No.: US 11,460,241 B1
(45) Date of Patent: Oct. 4, 2022

(54) REFRIGERATOR AND SHELVING SYSTEM FOR A REFRIGERATOR

(71) Applicant: WHIRLPOOL CORPORATION, Benton Harbor, MI (US)

(72) Inventors: Vishal B. Chauhan, Palghar (IN); Mandar Kulkarni, Pune (IN); Ritesh Solanki, Vasai (IN)

(73) Assignee: WHIRPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/370,546

(22) Filed: Jul. 8, 2021

(51) Int. Cl.
*F25D 25/02* (2006.01)
*F25D 23/06* (2006.01)

(52) U.S. Cl.
CPC ..... *F25D 25/027* (2013.01); *F25D 23/067* (2013.01); *F25D 25/021* (2013.01); *F25D 25/024* (2013.01); *F25D 2325/021* (2013.01)

(58) Field of Classification Search
CPC ..... F25D 23/04; F25D 23/067; F25D 25/021; F25D 25/024; F25D 25/027; F25D 2325/021
See application file for complete search history.

(56) References Cited

U.S. PATENT DOCUMENTS 2,776,866 A * 1/1957 Harbison ..... F25D 23/04 312/311
2,808,310 A * 10/1957 Patterson, Jr. ..... F25D 23/04 312/325
4,528,825 A 7/1985 Khan
7,618,103 B2 * 11/2009 Kim ..... A47B 46/00 108/138
7,950,756 B2 * 5/2011 Collins ..... F25D 25/02 312/408

FOREIGN PATENT DOCUMENTS

| | | | | |
|---|---|---|---|---|
| CN | 102384631 A * | 3/2012 | ..... | F25D 25/02 |
| CN | 202648298 U | 1/2013 | | |
| CN | 107091556 | 8/2017 | | |
| CN | 109696031 A | 4/2019 | | |
| EP | 3822565 A1 * | 5/2021 | ..... | F25D 25/02 |
| IN | 201711015537 | 3/2019 | | |
| KR | 1020040039748 A * | 5/2004 | ..... | F25D 25/021 |
| KR | 100650745 B1 * | 11/2006 | | |
| WO | WO-2012022653 A2 * | 2/2012 | ..... | F25D 25/021 |

* cited by examiner

*Primary Examiner* — Andrew M Roersma
(74) *Attorney, Agent, or Firm* — Brooks Kushman P.C.

(57) ABSTRACT

A refrigerator shelving system includes a first shelf, a first set of suspenders, a second set of suspenders, and a second shelf. The second shelf is rotatably secured to the second set of suspenders and slidably secured to the second set of suspenders. The second set of suspenders is rotatably secured to the first shelf. A back end of the second shelf is configured to rotate relative to the first set of suspenders, the second set of suspenders is configured to rotate relative to the first shelf, and a front end of the second shelf is configured to slide relative to the second set of suspenders during rotation of the second set of suspenders in order to transition the second shelf between an operational position and a stowed position.

19 Claims, 6 Drawing Sheets

REFRIGERATOR AND SHELVING SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator shelving system includes a first shelf, a first pair of opposing suspenders, a second pair of opposing suspenders, and a second shelf. The first shelf has at least one hook protruding therefrom and is secured to an internal wall of a refrigerator via the at least one hook. The first pair of opposing suspenders extend downward from a back end of first shelf and are rigidly affixed to the first shelf. The second pair of opposing suspenders extend downward from a middle portion of the first shelf and are rotatably secured to the first shelf. The second shelf has a second back end rotatably secured to lower ends of each suspender of the first pair of opposing suspenders and a front end slidably secured to each suspender of the second pair of opposing suspenders. The second back end is configured to rotate relative to the first pair of opposing suspenders, the second pair of opposing suspenders is configured to rotate relative to the middle portion, and the front end of the second shelf is configured to slide relative to the second pair of suspenders during rotation of the second pair of suspenders in order to transition the second shelf between an operational position and a stowed position.

A refrigerator shelving system includes a first shelf, a first pair of opposing suspenders, a second pair of opposing suspenders, and a second shelf. The first shelf has a first front end, a first back end, and a first length extending from the first front end to the first back end. The first pair of opposing suspenders extends downward from the first back end. The second pair of opposing suspenders extends downward from a middle portion of the first shelf. The middle portion is disposed between the first front end and the first back end. The second shelf has a second front end, a second back end, and a second length extending from the second front end to the second back end. The second length is shorter than the first length. The second back end is secured to lower ends of each suspender of the first pair of opposing suspenders. The second front is secured to each suspender of the second pair of opposing suspenders. The second back end is configured to rotate relative to the first pair of opposing suspenders, the second pair of opposing suspenders is configured to rotate relative to the middle portion, and the second front end is configured to slide relative to the second pair of suspenders during rotation of the second pair of suspenders in order to transition the second shelf between an operational position and a stowed position.

A refrigerator shelving system includes a first shelf, a first set suspenders, a second set of suspenders, and a second shelf. The first shelf has a first front region and a first back region. The first set of suspenders extends downward from the first back region. The second set of suspenders extends downward from a middle region of the first shelf. The middle region is disposed between the first front region and the first back region. The second shelf has a second back region secured to lower regions of each suspender of the first set of suspenders and a second front region secured to each suspender of the second set of opposing suspenders. The second back region is configured to rotate relative to the first set of suspenders, the second set of suspenders is configured to rotate relative to the middle region, and the second front region is configured to slide relative to the second set of suspenders during rotation of the second set of suspenders in order to transition the second shelf between first and second positions. The first shelf is substantially parallel to and below the first shelf in the first position. The second shelf is substantially perpendicular to the first shelf and adjacent to the back region of the first shelf in the second position.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
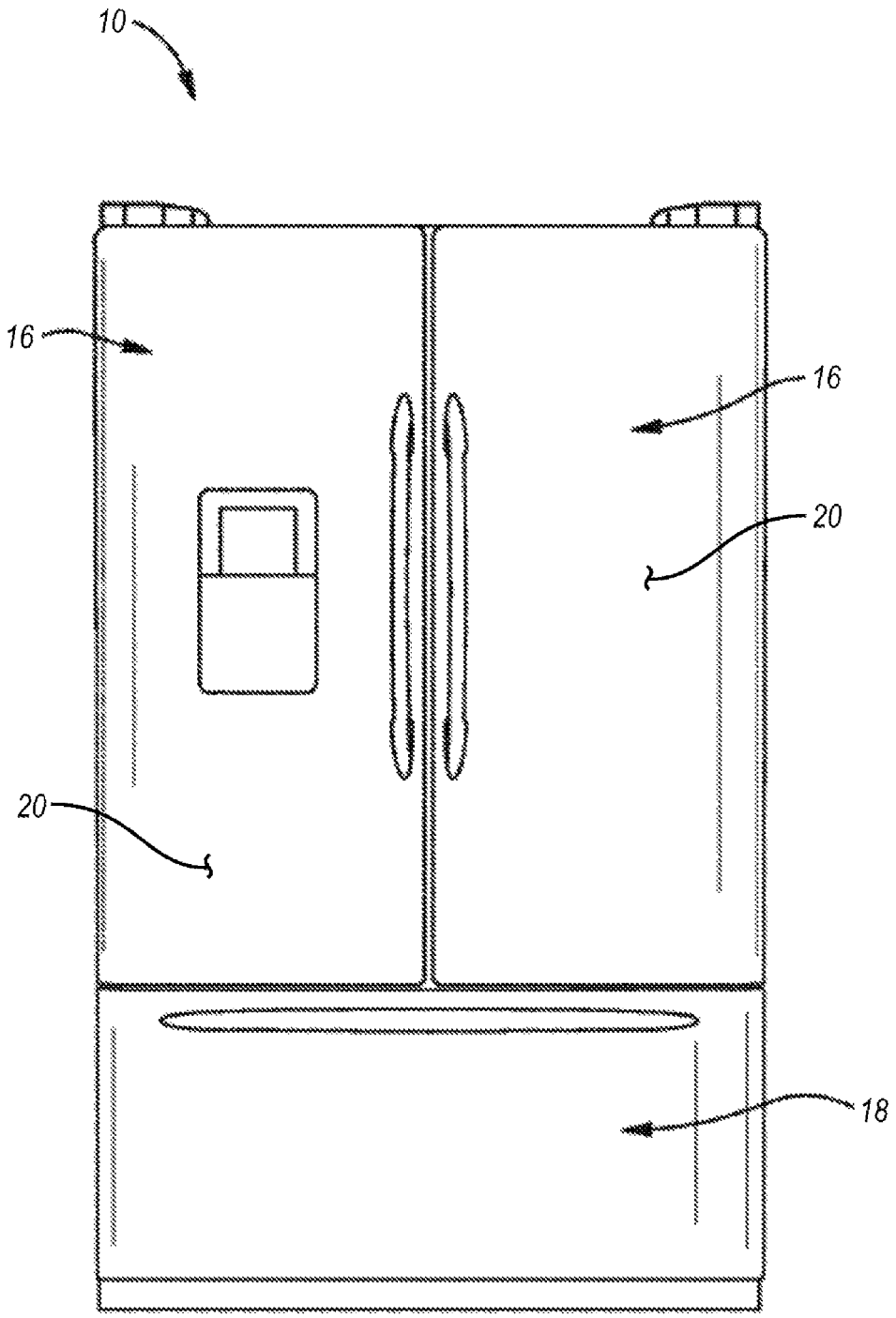
FIG. 1 is an elevated front view of a French-Door Bottom Mount type refrigerator appliance.
Figure 2:
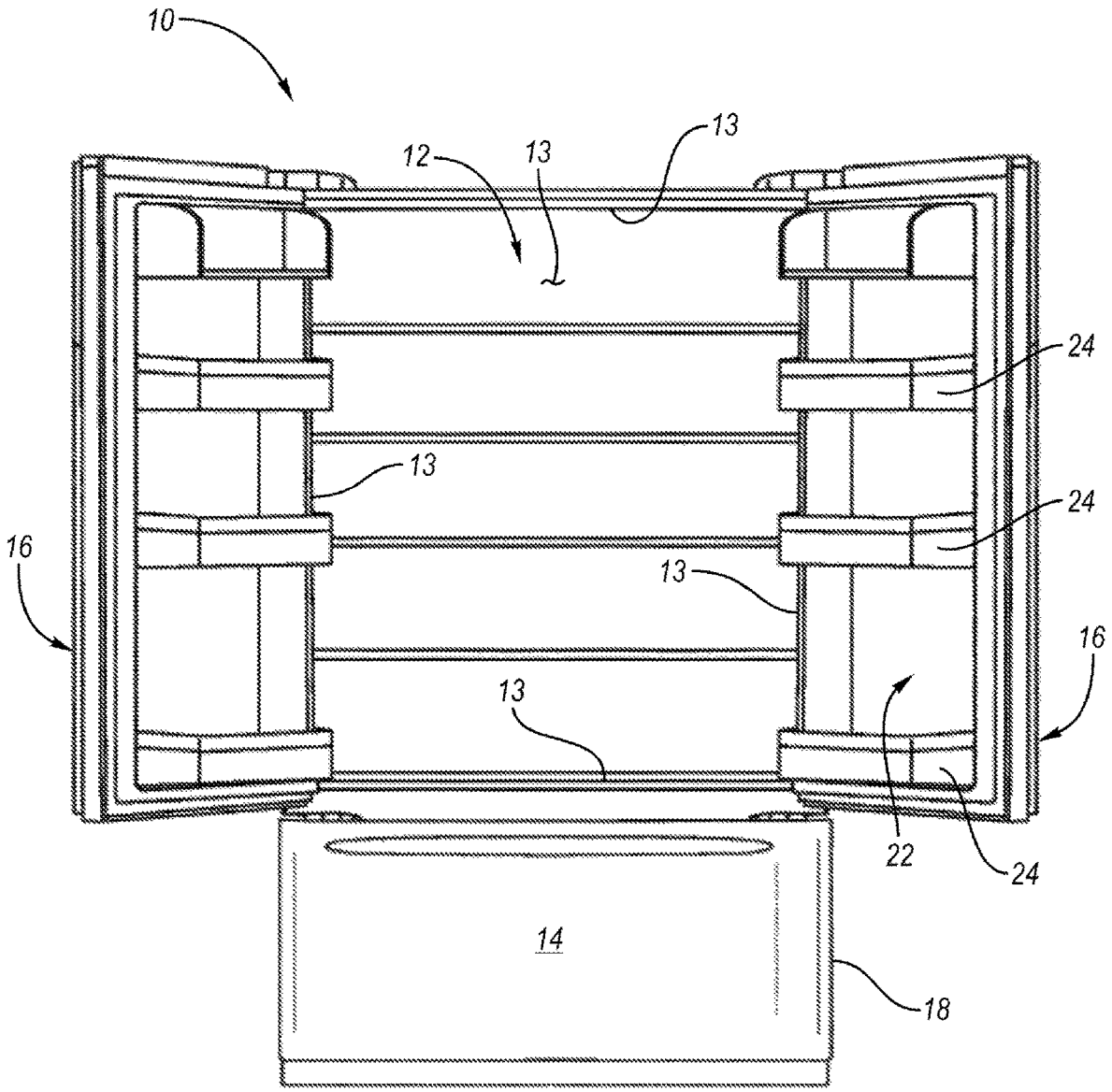
FIG. 2 is an elevated front view of a French-Door Bottom Mount type refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes panels or internal walls 13 that form a housing and define the fresh food compartment 12 and the freezer compartment 14. The walls 13 may more specifically form an internal liner of the refrigerator 10. The walls 13 may include a rear or back wall, a top wall, a bottom wall, and two side walls. One or more shelves may be secured to the walls 13 within the food compartment 12. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-7, a shelving system 26 for the refrigerator 10 is illustrated. The shelving system 26 may be disposed within the internal chamber (i.e., the fresh food compartment 12) of the refrigerator 10. A single shelving system 26 or multiple shelving systems that are identical to shelving system 26 may be disposed within the internal chamber of the refrigerator. It should be noted that any shelves illustrated in FIG. 2 may be removed or rearranged to create space for one or more of the shelving systems 26. The shelving system 26 may include one or more support arms 28 that engage one of the walls 13 that define the internal chamber 12 in order to secure the position of the shelving system 26 within the internal chamber 12. More specifically, hooks 30 defined along the end of the support arms 28 may extend into notches 32 defined by the wall 13 and may engage upwardly extending protrusions 34, bumps, walls, etc. within the notches 32 to secure the position of the shelving system 26 within the internal chamber 12. The wall 13 may define a plurality of vertically aligned notches 32 having protrusions 34 disposed therein so that the shelving system 26 can be adjusted upward or downward between notches 32 in order to adjust a height of the shelving system 26 within the internal chamber 12.

The shelving system includes a first shelf 36. The first shelf 36 may be secured to the support arms 28 such that the hooks 30 protrude from the first shelf 36, and such that the first shelf 36 is secured to the internal wall 13 via the hooks 30. The support arms 28 may be disposed along lateral sides of the first shelf 36. The support arms 28 may be built-in or integral to the first shelf 36. It is noted that a panel that defines an upper surface of the first shelf 36 is illustrated as being made from a transparent material, such as glass, for illustrative purposes. It should also be noted that although the panel could be made from such a transparent material, this disclosure should not be construed as limited to such a configuration.

The first shelf 36 has a front region or end 38, a back region or end 40, and a first length $L_1$ extending from the front end 38 to the back end 40. A first set or pair of hangers or suspenders 42 may extend downward from the back end 40 of first shelf 36. The first set or pair of suspenders 42 may more specifically be a first pair of opposing suspenders disposed at opposite lateral sides of the back end 40 of first shelf 36. The first pair of suspenders 42 may be rigidly affixed to the first shelf 36. A second set or pair of hangers or suspenders 44 may extend downward from a middle region or portion 46 of the first shelf 36. The middle portion 46 of the first shelf 36 is disposed between the front end 38 and the back end 40 of the first shelf 36. The second set or pair of suspenders 44 may more specifically be a second pair of opposing suspenders disposed at opposite lateral sides of the middle portion 46 of first shelf 36. The second pair of suspenders 44 may be rotatably secured to the first shelf 36 via protrusions or pins 48. More specifically, the second pair of suspenders 44 may be rotatably secured to the support arms 28 via the pins 48. Even more specifically, the second pair of suspenders 44 may be rotatably secured to internal lateral side surfaces of the support arms 28 via the pins 48.

The shelving system 36 has a second shelf 50 that is secured to the first shelf 36 via the first pair of suspenders 42 and the second pair of suspenders 44. The second shelf 50 has a front region or end 52, a back region or end 54, and a second length $L_2$ extending from the front end 52 to the back end 54. The second length $L_2$ is shorter than the first length $L_1$.

The back end 54 of the second shelf 50 is secured to lower regions or ends of each suspender of the first pair of suspenders 42. More specifically, the back end 54 of the second shelf 50 maybe secured to lower ends of each suspender of the first pair of suspenders 42 along lateral sides 56 of the second shelf 50. Even more specifically, the back end 54 of the second shelf 50 may be rotatably secured to lower ends of each suspender of the first pair of suspenders 42 via protrusions or pins 58 that extend into holes or orifices. The pins 58 may be disposed on the second shelf 50 and the holes or orifices may be defined by the first pair of suspenders 42, or vice versa.

The front end 52 of the second shelf 50 is secured to each suspender of the second pair of suspenders 44. More specifically, the front end 52 of the second shelf 50 maybe secured to each suspender of the second pair of suspenders 44 along the lateral sides 56 of the second shelf 50. Even more specifically, the front end 52 of the second shelf 50 maybe slidably secured to each suspender of the second pair of suspenders 44 via protrusions or pins 60 that extend into and are slidable within slots 62 defined by the second pair of suspenders 44.

The second shelf 50 is configured to transition between an operational position and a stowed position. The operational position may be referred to as the first position and the stowed position may be referred to as the second position, or vice versa.

Figure 3:
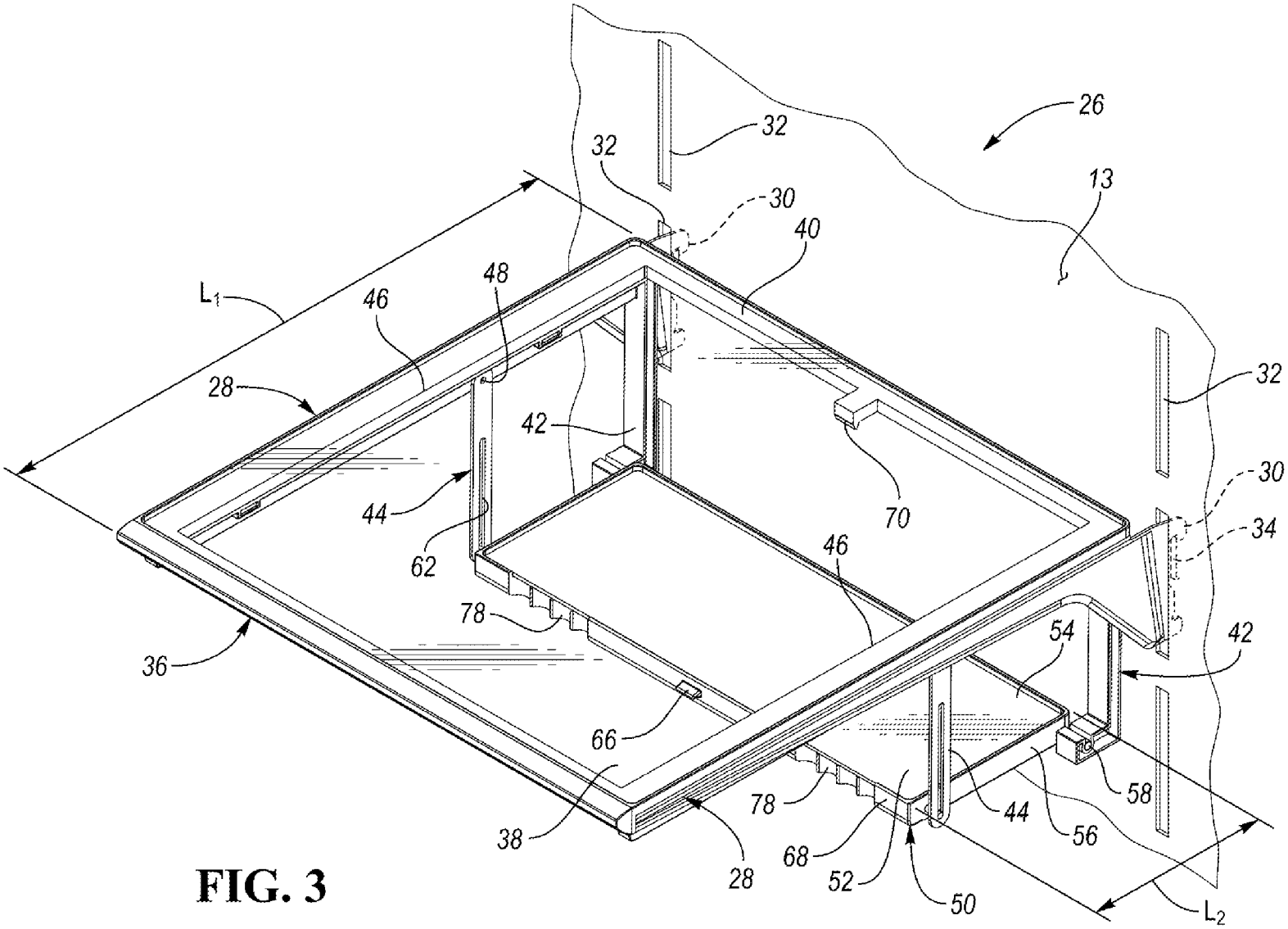
FIG. 3 is a top isometric view of a shelving system for the refrigerator that includes first and second shelves with the second shelf in an operational position.

In the operational position, which is illustrated in FIG. 3, the second shelf 50 is substantially parallel to the first shelf 36 and a space is defined between the first shelf 36 and the second shelf 50 so that items (e.g., food items) may be placed onto the second shelf 50. Substantially parallel may refer to any incremental angle between exactly parallel and 10° from exactly parallel. It should also be noted that in the operational position, both the first shelf 36 and the second shelf 50 are substantially horizontal so that items may be placed onto either the first shelf 36 or the second shelf 50 without rolling or falling off of the first shelf 36 or the second shelf 50. Substantially horizontal may refer to any incremental angle between exactly horizontal and 10° from exactly horizontal.

Figure 5:
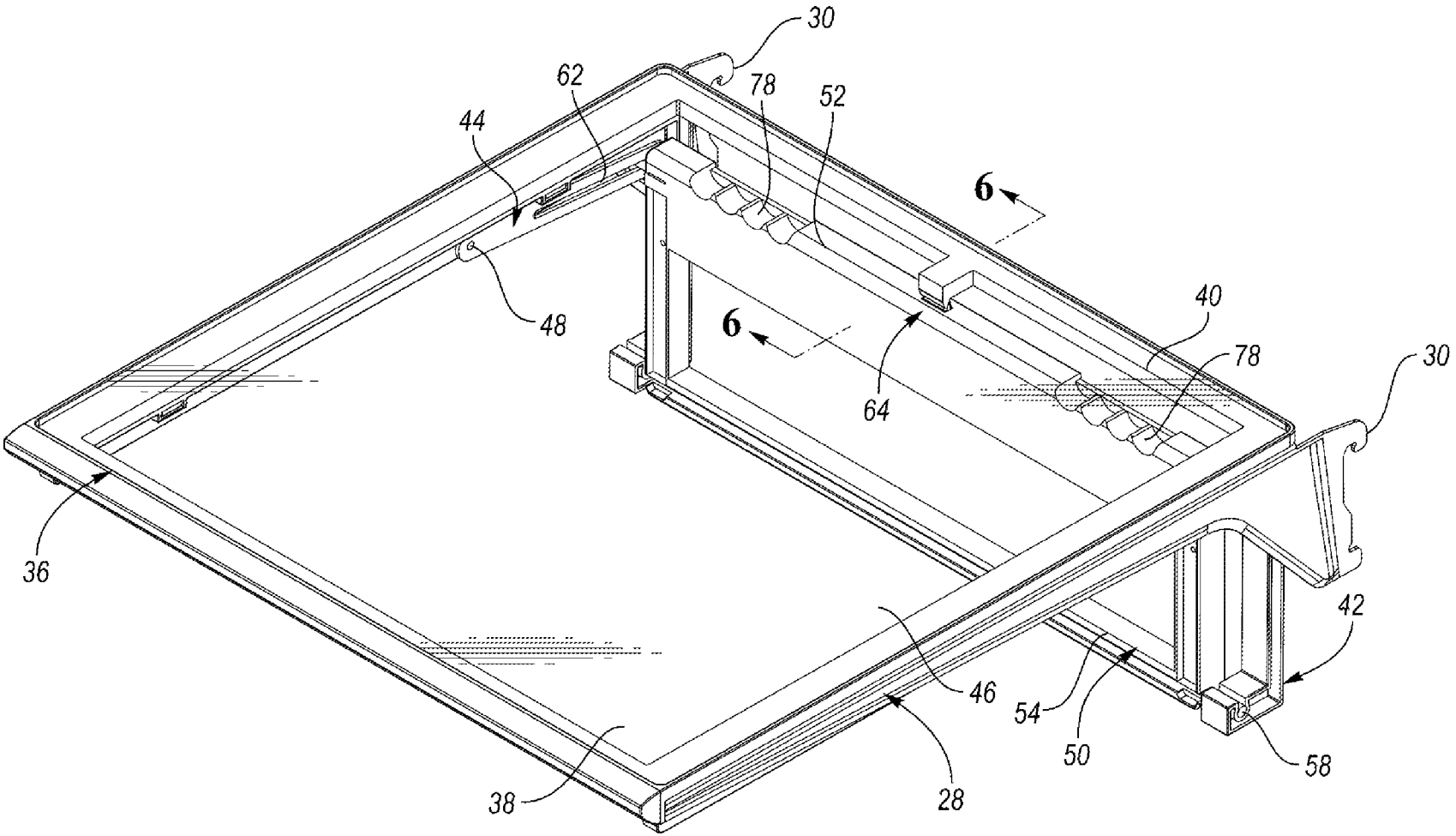
FIG. 5 is a top isometric view of the shelving system with the second shelf in the stowed position.
Figure 6:
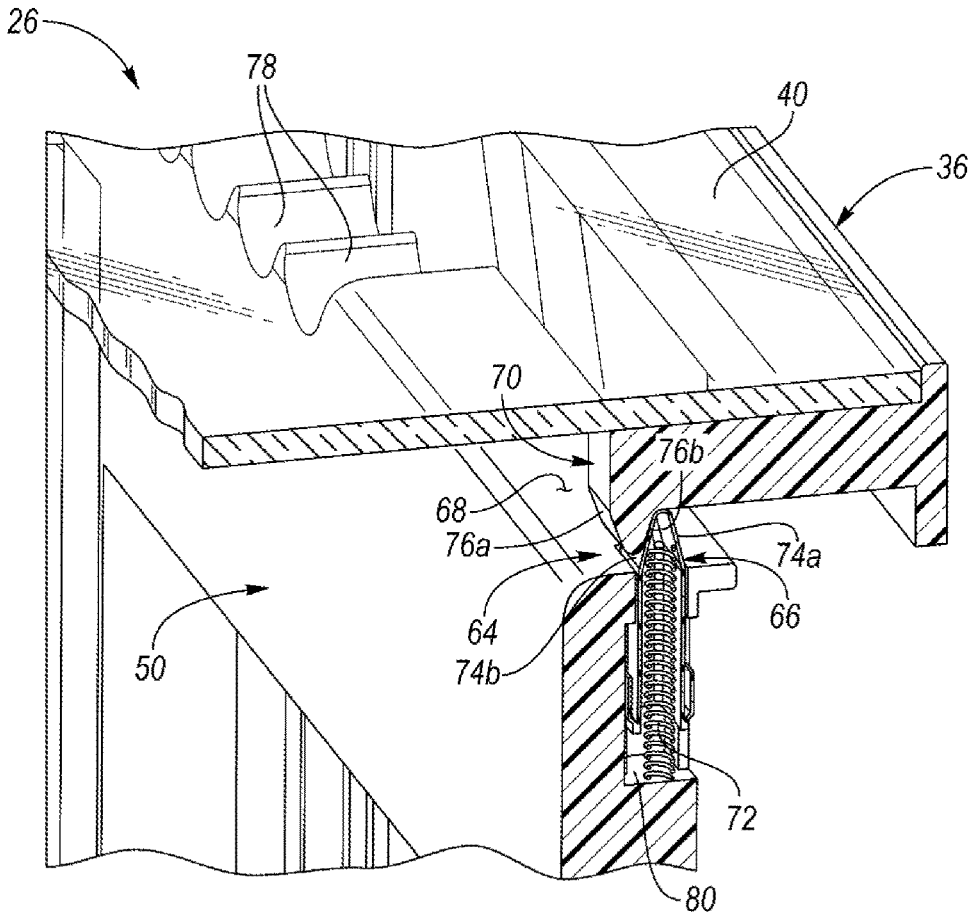
FIG. 6 is a cross-sectional view taken along line 6-6 in FIG. 5.
Figure 7:
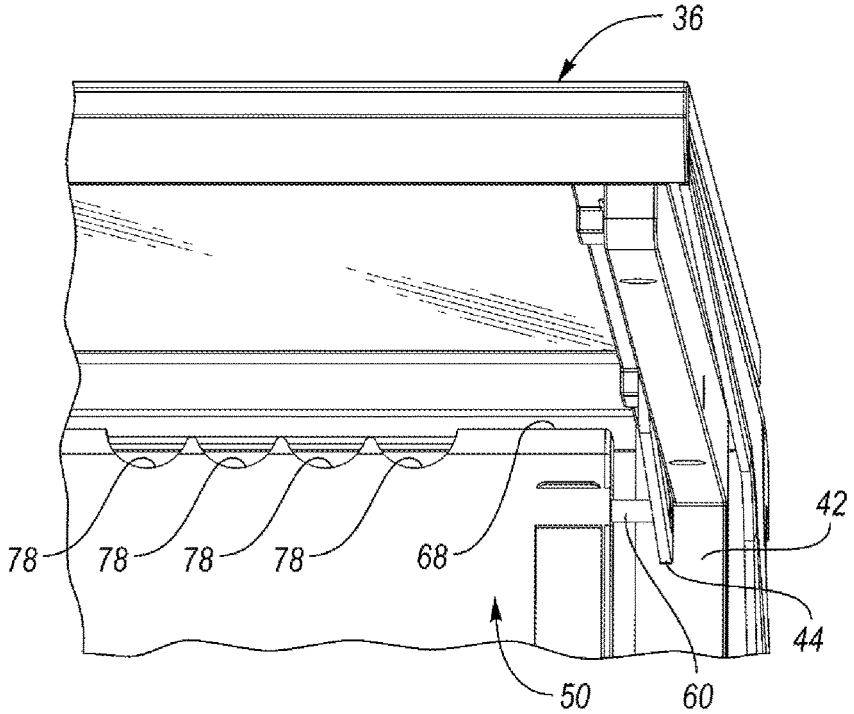
FIG. 7 is a partial lower isometric view of the shelving system with the second shelf in the stowed position.

In the stowed position, which is illustrated in FIG. 5, the second shelf 50 is substantially perpendicular to the first shelf 36 and the second shelf 50 is tucked away such that the second shelf 50 is adjacent the back end 40 of the first shelf 36 and adjacent to the internal wall 13 of the refrigerator 10 in order to create additional space within the internal chamber 12 below the first shelf 36. Such additional space below the first shelf 36 may be desirable if tall items (e.g., wine bottles) are placed onto a shelf that is below shelving system 26. Substantially perpendicular may refer to any incremental angle between exactly perpendicular and 10° from exactly perpendicular. The second shelf 50 may also be substantially parallel with the first pair of suspenders 42 and the internal wall 13 in the stowed position. Substantially parallel may refer to any incremental angle between exactly parallel and 10° from exactly parallel.

Figure 4:
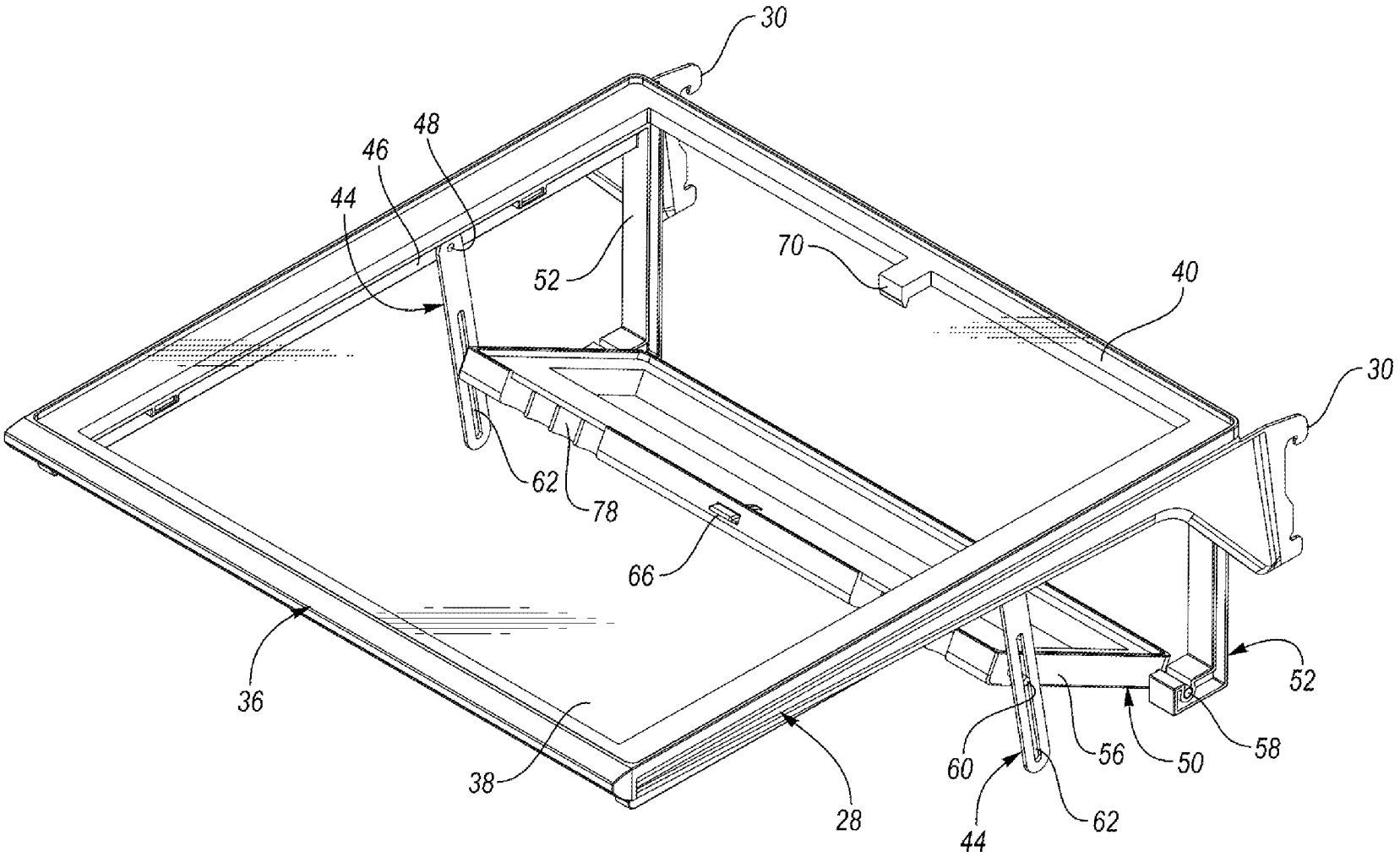
FIG. 4 is a top isometric view of the shelving system with the second shelf in an intermediate position between the operational position and a stowed position.

In order to transition between the operational position (FIG. 3) and the stowed position (FIG. 5), (i) the back end 54 of the second shelf 50 is configured to rotate relative to the first pair of suspenders 42 via pins 58, (ii) the second pair of suspenders 44 is configured to rotate relative to the first shelf 36 via pins 48, and (iii) the front end 52 of the second shelf 50 is configured to slide relative to the second pair of suspenders 44, via the pins 60 sliding within the slots 62 during rotation of the second pair of suspenders 44, in order to transition the second shelf 50 between the operational position and the stowed position. It may be stated that the second pair of suspenders 44 is be configured to rotate relative to the middle region or portion 46 of the first shelf 36 via the pins 48 during such a transition. As previously stated, FIG. 3 illustrates the second shelf 50 in operational position and FIG. 5 illustrates the second shelf 50 the stowed position. FIG. 4 on the other hand illustrates an intermediate position between the operation position and the stowed position during a transition between the operation position and the stowed position.

The shelving system 26 may further include a locking mechanism 64 that is configured to secure the second shelf 50 in the stowed position. The locking mechanism 64 may include a tab 66 protruding from a front surface 68 of the second shelf 50 and a hook 70 extending downward from the back region or end 40 of first shelf 36. The tab 66 is configured to engage the hook 70 to secure the second shelf 50 in the stowed position (See FIGS. 5 and 6). The tab 66 may be spring-loaded via spring 72 such that engagement between ramped surfaces 74*a*, 74*b* on the tab 66 and ramped surfaces 76*a*, 76*b* on the hook 70 allow displacement of the tab 66 during engagement and disengagement. The tab 66 and the spring 72 may each be at least partially disposed within a slot 80 defined within the second shelf 50. The tab 66 may be configured to retract into the slot 80 during engagement between ramped surfaces 74*a*, 74*b* on the tab 66 and ramped surfaces 76*a*, 76*b* on the hook 70.

During engagement where the second shelf 50 is pushed towed the hook 70, a front ramped surface 74*a* of the tab 66 engages a front ramped 76*a* surface of the hook 70 displacing the tab 66 such that the tab 66 is retracted into the slot 80. As the tab 66 moves beyond an apex of the hook 70, the spring 72 causes the tab 66 to spring back such that a back ramped surface 74*b* of the tab 66 engages a back ramped surface 76*b* of the hook 70 to secure the second shelf in the stowed position.

During disengagement where the second shelf 50 is pull away from the hook, the back ramped surface 74*b* of the tab 66 engages the back ramped 76*b* surface of the hook 70 displacing the tab 66 such that the tab 66 is retracted into the slot 80. As the tab 66 moves beyond the apex of the hook 70, the tab 66 disengages the hook 70 and the second shelf 50 may then transition to the operational position. The spring 72 also causes the tab 66 to spring back once the tab 66 has moved beyond the apex of the hook 70 during disengagement.

The front surface 68 of the second shelf 50 may also define scalloped notches 78. The scalloped notches 78 that are configured to provide a place for an operator's fingers to grab the second shelf 50 during a transition between the operational position and the stowed position of the second shelf 50. The scalloped notches 78 also provide clearance for the operator's fingers during transitions between the operational position and the stowed position to prevent interference between the operator's finger and the first shelf 36 or other components of the shelving system 26 and refrigerator 10.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator shelving system comprising:

a first shelf having at least one hook protruding therefrom and secured to an internal wall of a refrigerator via the at least one hook;

a first pair of opposing suspenders extending downward from a back end of the first shelf and rigidly affixed to the first shelf;

a second pair of opposing suspenders extending downward from a middle portion of the first shelf and rotatably secured to the first shelf; and a second shelf having a second back end rotatably secured to lower ends of each suspender of the first pair of opposing suspenders and a front end slidably secured to each suspender of the second pair of opposing suspenders, wherein (i) the second back end is configured to rotate relative to the first pair of opposing suspenders, (ii) the second pair of opposing suspenders is configured to rotate relative to the middle portion, and (iii) the front end of the second shelf is configured to slide relative to the second pair of suspenders during rotation of the second pair of suspenders to transition the second shelf between an operational position and a stowed position.

2. The refrigerator shelving system of claim 1, wherein second shelf is substantially parallel with the first shelf in the operational position.

3. The refrigerator shelving system of claim 2, wherein the second shelf is substantially perpendicular to the first shelf in the stowed position.

4. The refrigerator shelving system of claim 3, wherein the second shelf is substantially parallel with the first pair of opposing suspenders in the stowed position.

5. The refrigerator shelving system of claim 1, wherein each of the suspenders of the second pair of opposing suspenders defines a slot, and wherein the second shelf has protrusions, each said protrusion extending into and slidable within one of the slots.

6. The refrigerator shelving system of claim 1 further comprising a locking mechanism that is configured to secure the second shelf in the stowed position.

7. The refrigerator shelving system of claim 6, wherein the locking mechanism includes a tab protruding from a front surface of the second shelf and a hook extending downward from the back end of the first shelf, and wherein the tab is configured to engage the hook to secure the second shelf in the stowed position.

8. The refrigerator shelving system of claim 1, wherein a front surface of the second shelf defines scalloped notches that are configured to provide clearance for an operator's fingers during transitions between the operational position and the stowed position.

9. A refrigerator shelving system comprising:

a first shelf having a first front end, a first back end, and a first length extending from the first front end to the first back end;

a first pair of opposing suspenders extending downward from the first back end;

a second pair of opposing suspenders extending downward from a middle portion of the first shelf, wherein the middle portion is disposed between the first front end and the first back end; and a second shelf having a second front end, a second back end, and a second length extending from the second front end to the second back end, wherein (i) the second length is shorter than the first length, (ii) the second back end is secured to lower ends of each suspender of the first pair of opposing suspenders, (iii) the second front end is secured to each suspender of the second pair of opposing suspenders, and wherein (i) the second back end is configured to rotate relative to the first pair of opposing suspenders, (ii) the second pair of opposing suspenders is configured to rotate relative to the middle portion, (iii) the second front end is configured to slide relative to the second pair of suspenders during rotation of the second pair of suspenders to transition the second shelf between an operational position and a stowed position, and (iv) the second shelf is substantially perpendicular to the first shelf in the stowed position.

10. The refrigerator shelving system of claim 9, wherein second shelf is substantially parallel with the first shelf in the operational position.

11. The refrigerator shelving system of claim 9, wherein the second shelf is substantially parallel with the first pair of opposing suspenders in the stowed position.

12. The refrigerator shelving system of claim 9, wherein each of the suspenders of the second pair of opposing suspenders defines a slot, and wherein the second shelf has protrusions, each said protrusion extending into and slidable within one of the slots.

13. The refrigerator shelving system of claim 9 further comprising a locking mechanism that is configured to secure the second shelf in the stowed position.

14. The refrigerator shelving system of claim 13, wherein the locking mechanism includes a tab protruding from a front surface of the second shelf and a hook extending downward from the first back end, and wherein the tab is configured to engage the hook to secure the second shelf in the stowed position.

15. The refrigerator shelving system of claim 9, wherein a front surface of the second shelf defines scalloped notches that are configured to provide clearance for an operator's fingers during transitions between the operational position and the stowed position.

16. A refrigerator shelving system comprising:

a first shelf having a first front region and a first back region;

a first set of suspenders extending downward from the first back region;

a second set of suspenders extending downward from a middle region of the first shelf, wherein the middle region is disposed between the first front region and the first back region; and a second shelf having a second back region secured to lower regions of each suspender of the first set of suspenders and a second front region secured to each suspender of the second set of opposing suspenders, wherein (i) the second back region is configured to rotate relative to the first set of suspenders, (ii) the second set of suspenders is configured to rotate relative to the middle region of the first shelf, and (iii) the second front region is configured to slide relative to the second set of suspenders during rotation of the second set of suspenders to transition the second shelf between first and second positions, wherein the second shelf is substantially parallel to and below the first shelf in the first position, and wherein the second shelf is substantially perpendicular to the first shelf and adjacent to the first back region of the first shelf in the second position.

17. The refrigerator shelving system of claim 16, wherein each of the suspenders of the second set of suspenders defines a slot, and wherein the second shelf has protrusions, each said protrusion extending into and slidable within one of the slots.

18. The refrigerator shelving system of claim 16 further comprising a locking mechanism that is configured to secure the second shelf in the second position.

19. The refrigerator shelving system of claim 16, wherein a front surface of the second shelf defines scalloped notches that are configured to provide clearance for an operator's fingers during transitions between the first position and the second position.

* * * * *